US010549450B2

(12) United States Patent
Saylor

(10) Patent No.: US 10,549,450 B2
(45) Date of Patent: Feb. 4, 2020

(54) FINGER JOINT ROUTER JIG

(71) Applicant: Saylor Solutions LLC, West Chester, OH (US)

(72) Inventor: Geoffrey D. Saylor, West Chester, OH (US)

(73) Assignee: Saylor Solutions LLC, West Chester ( * ) Notice: Subject to any disclaimer, the term of this patent is extended or adjusted under 35 U.S.C. 154(b) by 232 days.

(21) Appl. No.: 15/696,578

(22) Filed: Sep. 6, 2017

(65) Prior Publication Data

US 2018/0065272 A1 Mar. 8, 2018

Related U.S. Application Data

(60) Provisional application No. 62/495,157, filed on Sep. 6, 2016.

(51) Int. Cl.

| | |
|---|---|
| ***B27F 1/16*** | (2006.01) |
| ***B27C 5/10*** | (2006.01) |
| ***B27C 5/06*** | (2006.01) |

(52) U.S. Cl.

CPC ..... *B27F 1/16* (2013.01); *B27C 5/06* (2013.01); *B27C 5/10* (2013.01)

(58) Field of Classification Search

CPC .... B27F 1/00; B27F 1/005; B27F 1/02; B27F 1/04; B27F 1/08; B27F 1/10; B27F 1/12; B27F 1/14; B27F 1/16; B27C 5/02; B27C 5/06; B27C 5/003; B25B 5/00; B25B 5/003; B25B 11/00; B25B 11/02

USPC ..... 269/45, 43, 138, 71, 55; 144/144.1

See application file for complete search history.

(56) References Cited

U.S. PATENT DOCUMENTS 4,871,002 A * 10/1989 Turner ..... B23Q 1/03 144/144.1

* cited by examiner

*Primary Examiner* — Matthew Katcoff
(74) *Attorney, Agent, or Firm* — Jenei LLC

(57) ABSTRACT

A router jig includes a router jig base having: (i) a first board guide that receives an end of a first board; (ii) a second board guide that receives an end of an aligned second board from an opposite side; and (iii) a router guide that receives an guides a finger joint tool of a hand router along a transverse direction to the first and second board guides to simultaneously impart finger joint grooves. A clamping mechanism selectively clamps the first and second boards respectively within the first and second board guides.

13 Claims, 8 Drawing Sheets

*FIG. 3*

FINGER JOINT ROUTER JIG

CLAIM OF PRIORITY UNDER 35 U.S.C. § 119

The present application for patent claims priority to Provisional Application No. 62/495,157 entitled "Finger Joint Router Jig" filed Sep. 6, 2016, and assigned to the assignee hereof and hereby expressly incorporated by reference herein.

BACKGROUND

1. Technical Field

The present disclosure relates in general to wood working jigs, and more particularly to wood working jigs for making finger joints.

2. Description of the Related Art

Trim molding is frequently finger jointed in order to maximize material usage. Finger jointed material is a more economical way to produce trim molding. One generally-known approach to creating finger joints include producing trim molding in large scale factory production runs using industrial finger joint machines. The other generally-known approach to creating finger joints includes using a table router.

Lumber milling companies have developed industrial-sized finger joint machines to join the offal or blocks into usable lengths. These computerized hydraulic industrial machines are used in factories far away from construction sites where the material is used. It is important that these finger jointing machines be capable of working with blocks of varying length to obtain the highest recovery of a clear grade lumber product from a low grade source lumber. Existing finger jointing machines can typically mill and press together blocks ranging from 4" in length up to offal 36" or longer. To avoid the additional step of sorting the short clear blocks into groups of uniform length, the machines are designed to accommodate blocks of assorted lengths in random order, within the above range. Thus, a 4" block may directly follow a 30" block, which may in turn be followed by a 16" block. Generally a single sequence of blocks will have the same thickness and width, but a finger jointing machine can usually be set to accept various thicknesses or widths of blocks by some adjustment or modification.

During residential and commercial construction, it is common to use commercially finger jointed finish trim and finger jointed studs for non-bearing walls. However, finger jointed finish trim lumber is the most commonly used. Commercially finger jointed finish trim is delivered to construction sites in 16' lengths. Due to room sizes this creates a lot of offal material. This offal material is commonly thrown in the garbage. There is no common standard for re-purposing or re-cycling this material. Additionally, when two sections of offal can be used, the joining ends are simply cut on an angle. Installed on the wall or surface overlapping one angle over the angle and nailed in place creating an inferior joint.

The other way trim was finger jointed was to us a router mounted under a router table. One end of the trim is jointed. Then the router depth would have to be reset to create an offset mating finger joint. Then the next piece can be routed. This process is very inaccurate and test pieces need to be routed to gauge accuracy. This second method is time and material consuming process that is very cumbersome and lacks accuracy.

BRIEF SUMMARY

In accordance with the teachings of the present disclosure, a router jig includes a router jig base having: (i) a first board guide that receives an end of a first board; (ii) a second board guide that receives an end of an aligned second board from an opposite side; and (iii) a router guide that receives an guides a finger joint tool of a hand router along a transverse direction to the first and second board guides to simultaneously impart finger joint grooves. A clamping mechanism selectively clamps the first and second boards respectively within the first and second board guides.

The above presents a general summary of several aspects of the disclosure in order to provide a basic understanding of at least some aspects of the disclosure. The above summary contains simplifications, generalizations and omissions of detail and is not intended as a comprehensive description of the claimed subject matter but, rather, is intended to provide a brief overview of some of the functionality associated therewith. The summary is not intended to delineate the scope of the claims, and the summary merely presents some concepts of the disclosure in a general form as a prelude to the more detailed description that follows. Other systems, methods, functionality, features and advantages of the claimed subject matter will be or will become apparent to one with skill in the art upon examination of the following figures and detailed written description.

BRIEF DESCRIPTION OF THE DRAWINGS

The description of the illustrative embodiments can be read in conjunction with the accompanying figures. It will be appreciated that for simplicity and clarity of illustration, elements illustrated in the figures have not necessarily been drawn to scale. For example, the dimensions of some of the elements are exaggerated relative to other elements. Embodiments incorporating teachings of the present disclosure are shown and described with respect to the figures presented herein, in which.

DETAILED DESCRIPTION

According to the present disclosure, a router jig is designed to mount on a work bench. Two pieces of trim molding are inserted from each end, meeting in the middle of the router jig. Then a clamping mechanism is engaged, securing the two pieces of trim molding in place. A hand held router with a finger joint bit installed is slid across a guide of the router jig, simultaneously routing the two pieces of molding trim to create a perfectly matched finger joint. Any variation in router speed, movement by operator, or other anomaly will still result in a matched finger joint due to the simultaneous and identical treatment of both pieces of trim molding.

References within the specification to "one embodiment," "an embodiment," "embodiments", or "one or more embodiments" are intended to indicate that a particular feature, structure, or characteristic described in connection with the embodiment is included in at least one embodiment of the present disclosure. The appearance of such phrases in various places within the specification are not necessarily all referring to the same embodiment, nor are separate or alternative embodiments mutually exclusive of other embodiments. Further, various features are described which may be exhibited by some embodiments and not by others. Similarly, various requirements are described which may be requirements for some embodiments but not other embodiments.

Figure 1:
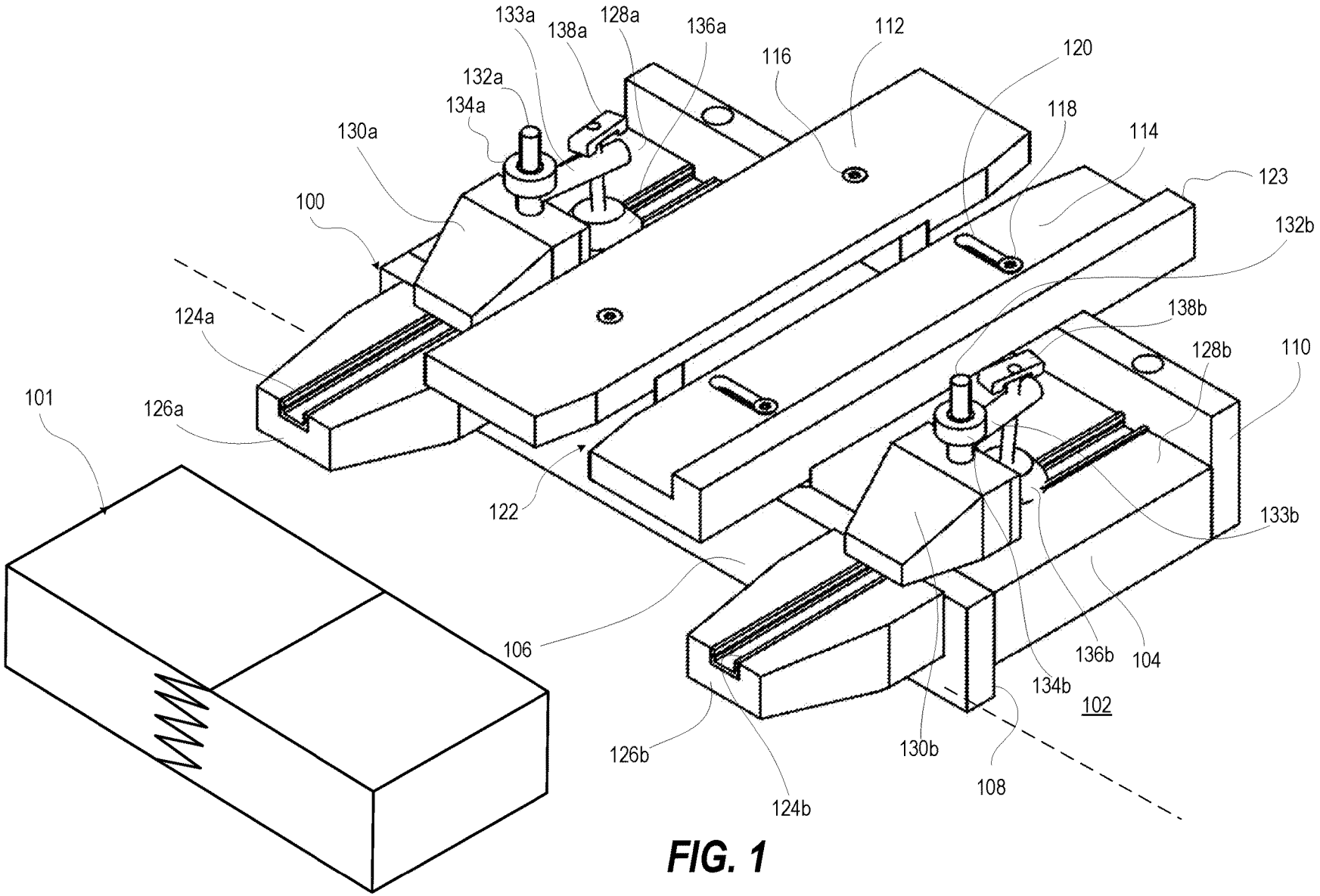
FIG. 1 illustrates an isometric view of a finger joint router jig, according to one or more embodiments.

FIG. 1 illustrates a router jig 100 for creating finger joints 101. The router jig 100 can be mounted on a workbench 102. A rectangular router jig base 104 rests onto the workbench 102. A front upright 106 is attached to the front of the router jig base 104 and has a bottom protruding stop lip 108 for aligning to an edge of the workbench 102. A rear upright 110 is attached to the a rear edge of the router jig base 104. The front and rear uprights 106, 110 support a fixed top guide plate 112 and an adjustable top guide plate 114. The fixed top guide plate 112 is mounted in place with mounting screws 116. The adjustable top guide plate 114 is moveable toward and away from a parallel aligned fixed top guide plate 112 by adjustable screws 118 that reside within respective lateral guide plate screw slots 120. The spacing between the top guide plates 112, 114 is part of a router bit pass through 122. A rightward edge of the adjustable top guide plate 114 includes an upward projecting block 123 that provide a front-to-back guide.

To the left of the fixed top guide plate 112, a left T-track 124*a* is upwardly presented from a left T-track support 126*a* extending forward from the front upright 106. The left T-track 124*a* traverses linearly across a left baseplate 128*a* up to the rear upright 110. A left block adjustable clamp body 130*a* is engaged to translate along the left T-track 124*a*. A left T-track screw 132*a* extends upward from the left T-track 124*a* through the left block clamp body 130*a*. A left arm clamp body 133*a* is received by the left T-track screw 132*a* and held down by a left T-track knob 134*a*. A rearward extending portion of the left arm clamp body 133*a* positions a left arm clamp foot 136*a* that extends downward toward the left baseplate 128*a* at an adjustable height set by a left arm clamp knob 138*a*.

To the right of the adjustable top guide plate 114, a right T-track 124*b* is upwardly presented from a right T-track support 126*b* extending forward from the front upright 106. The right T-track 124*b* traverses linearly across a right baseplate 128*b* up to the rear upright 110. A right block adjustable clamp body 130*b* is engaged to translate along the right T-track 124*b*. A right T-track screw 132*b* extends upward from the right T-track 124*b* through the right block clamp body 130*b*. A right arm clamp body 133*b* is received by the right T-track screw 132*b* and held down by a right T-track knob 134*b*. A rearward extending portion of the right arm clamp body 133*b* positions a right arm clamp foot 136*b* that extends downward toward the right baseplate 128*b* at an adjustable height set by a right arm clamp knob 138*b*.

Figure 2:
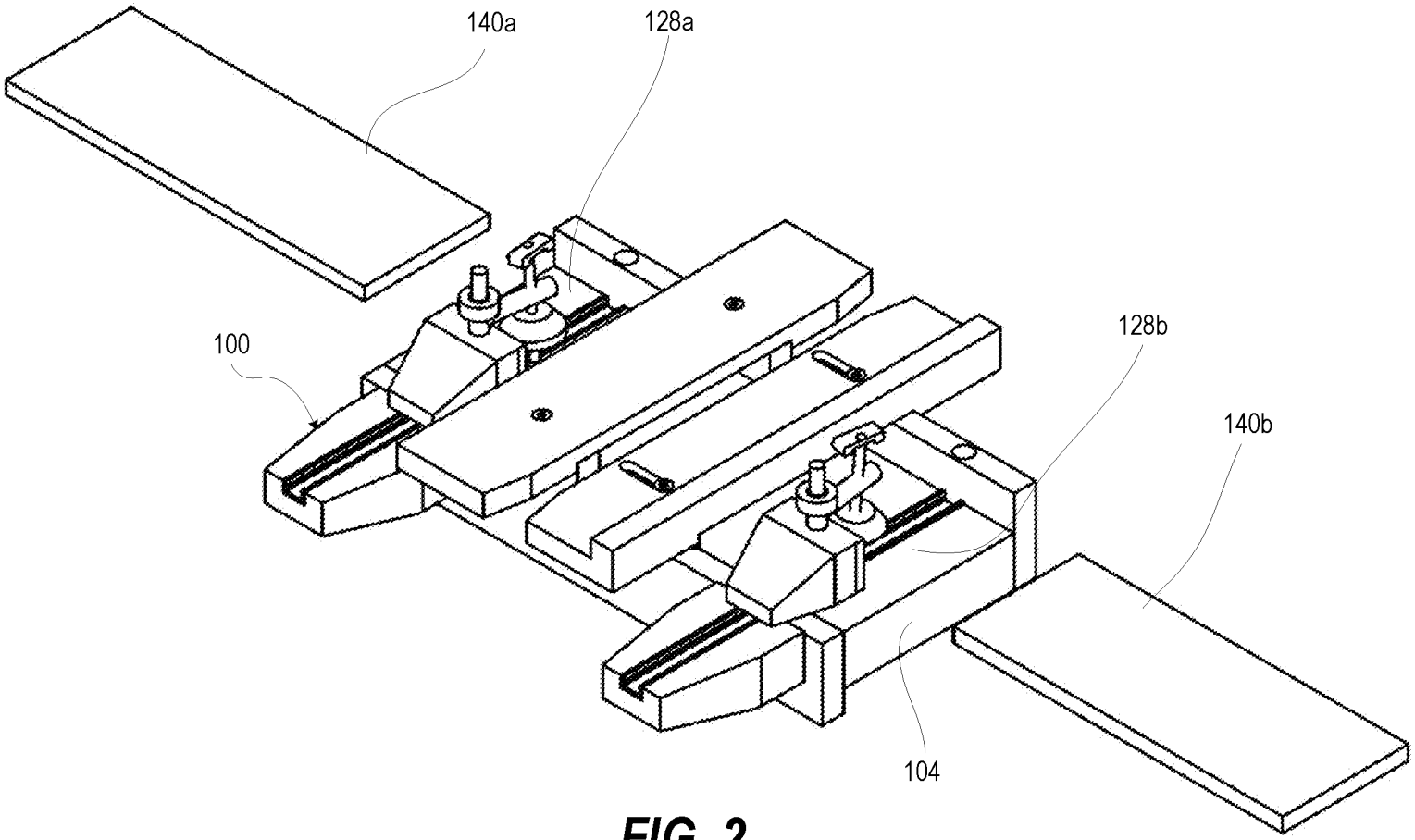
FIG. 2 illustrates an isometric view of the finger joint router jig with two trim boards, according to one or more embodiments.

FIG. 2 illustrates the router jig 100 with the left baseplate 128*a* of the router jig base 104 receives one piece of trim 140*a* and the right baseplate 128*b* of the router jig base 104 receives another piece of trim 140*b* from an opposite side. The right baseplate 128*b* is lower than the left baseplate 128*a* by the depth of one tooth of a router cutting blade (not shown). Thereby, simultaneously routing the two pieces of trim 140*a*-140*b* results in corresponding fingers and cuts for proper alignment of a finger joint. The height difference can be fixed to correspond to specific dimension of the finger joints. Alternatively, different thickness of shim boards can be inserted onto one of the baseplates. In an additional alternative, an adjustment mechanism can raise one of the baseplates relative to the other.

Figure 3:
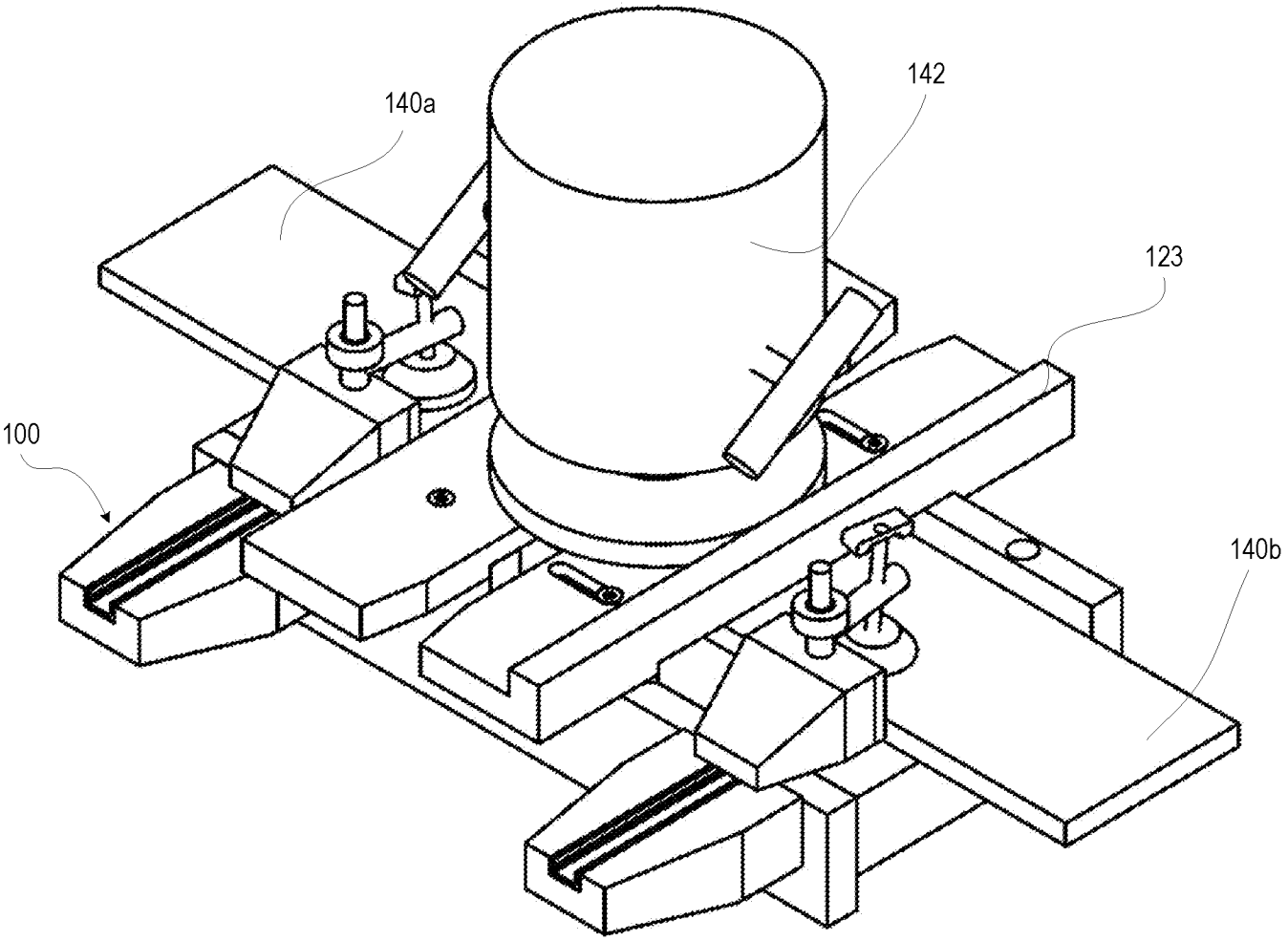
FIG. 3 illustrates an isometric view of the finger joint router jig with the two trim boards inserted and clamped and being routered, according to one or more embodiments.
Figure 4:
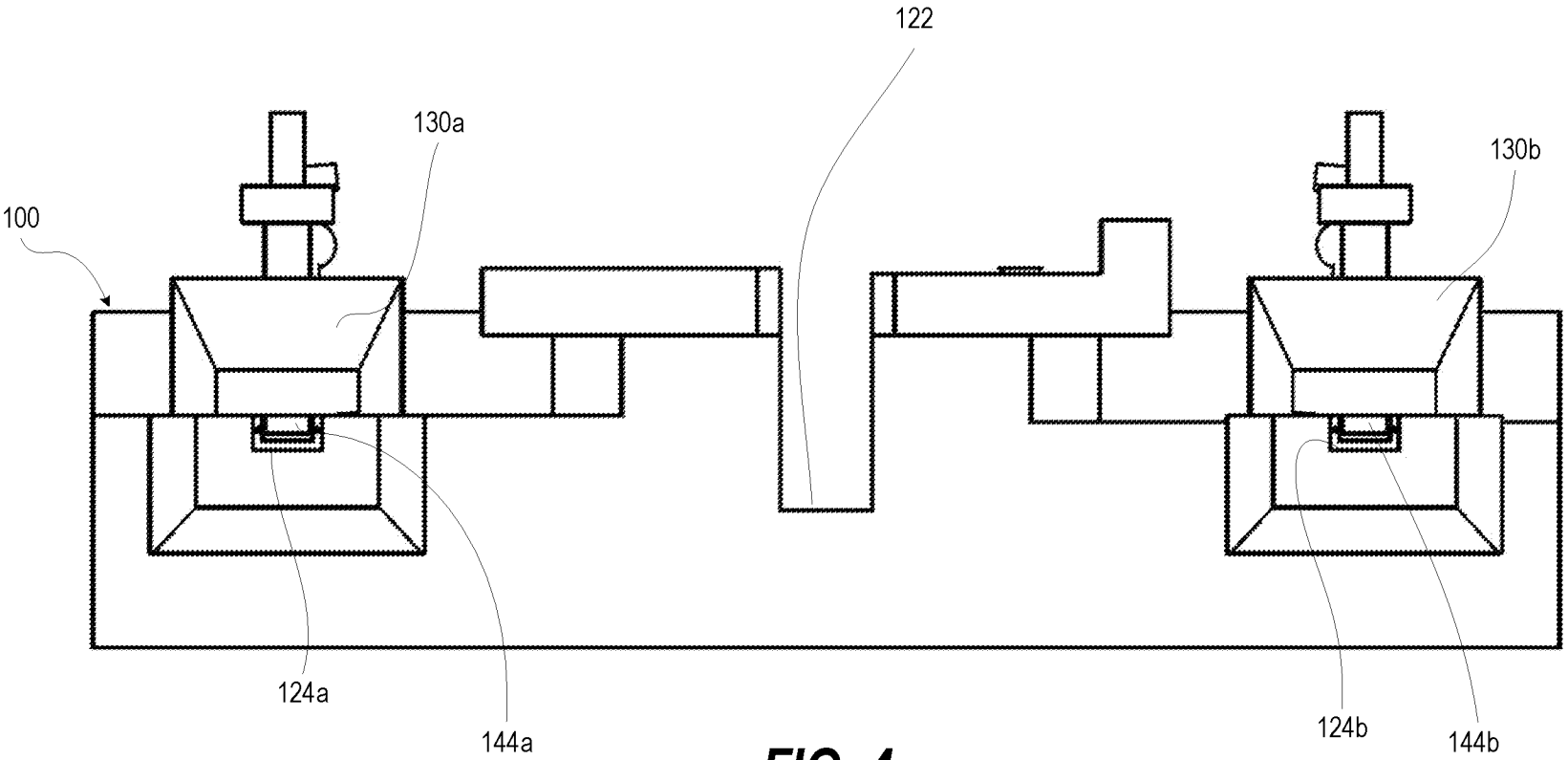
FIG. 4 illustrates a front view of the finger joint router jig, according to one or more embodiments.
Figure 5:
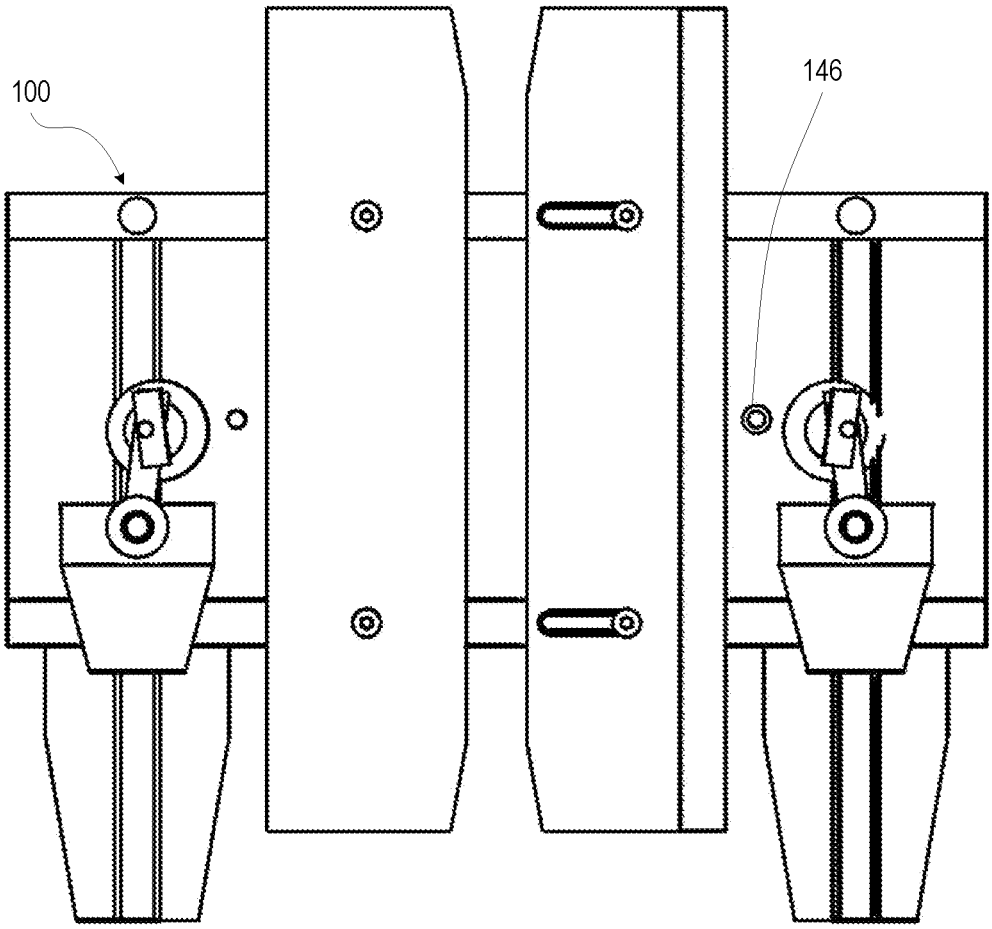
FIG. 5 illustrates a top view of the finger joint router jig, according to one or more embodiments.
Figure 6:
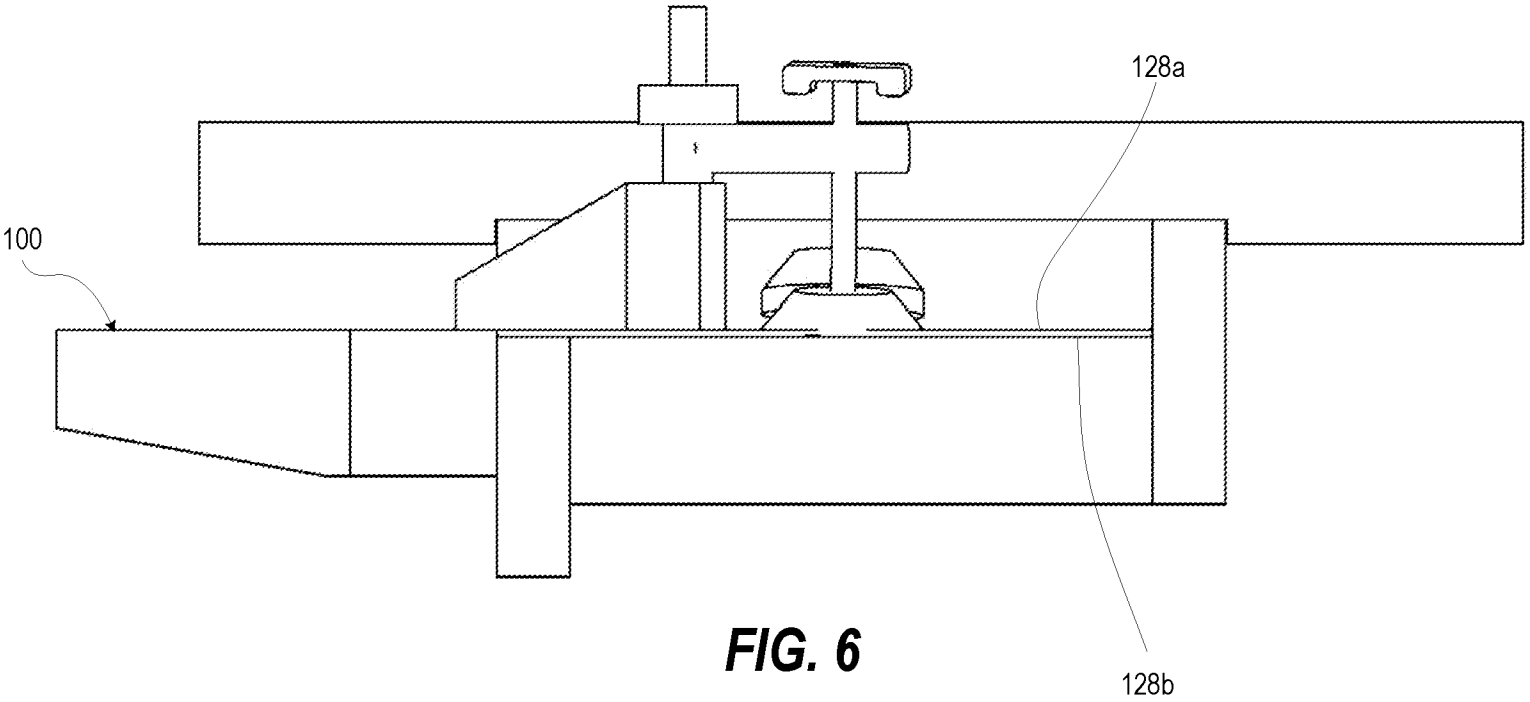
FIG. 6 illustrates a right side view of the finger joint router jig, according to one or more embodiments.
Figure 7:
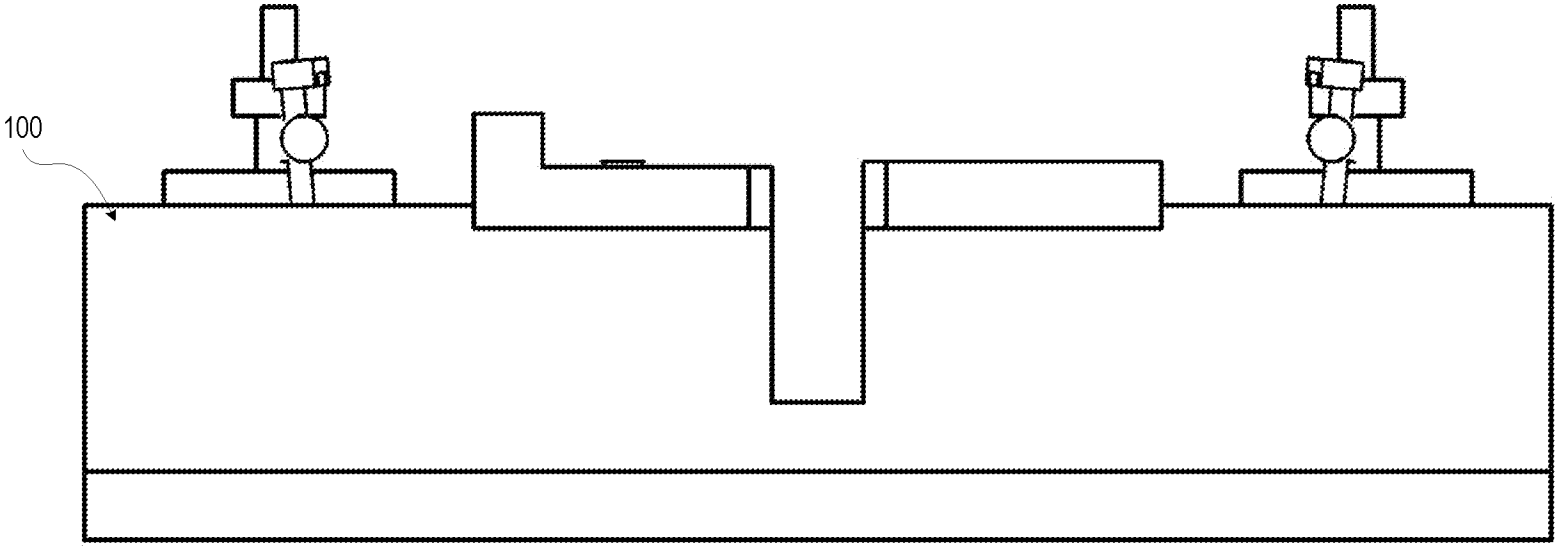
FIG. 7 illustrates a rear view of the finger joint router jig, according to one or more embodiments.
Figure 8:
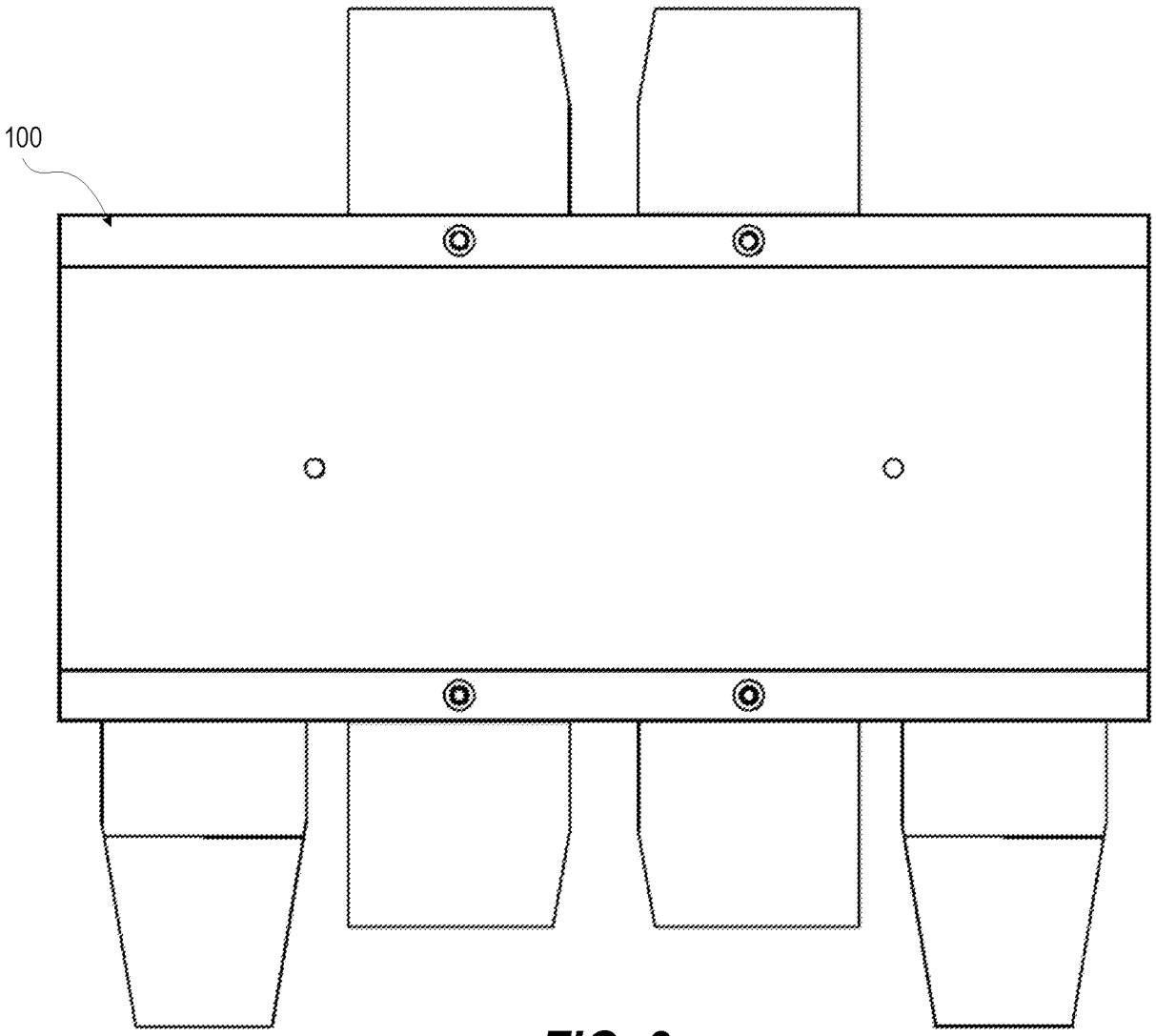
FIG. 8 illustrates a bottom view of the finger joint router jig, according to one or more embodiments.

FIG. 3 illustrates the router jig 100 having the trim 140*a*-140*b* inserted and clamped. A router 142 is inserted into the router jig 100 to simultaneously finger rout the trim 140*a*-140*b* for a perfect match. The router 142 slides along the top guide plates 112, 114 and aligned by the block 123. FIG. 4 illustrates that each block clamp body 130*a*-130*b* of the router jig 100 is attached to T-track head 144*a*-144*b* that slidingly engages the respective T-track 124*a*-124*b*. The router bit pass through 122 is depicted. FIG. 5 illustrates screw holes 146 through the router jig base 104 for fastening down the router jig 100. FIG. 6 illustrates that the right baseplate 128*b* is lower than the left baseplate 128*a*. FIG. 7 illustrates the back of the router jig 100. FIG. 8 illustrates the bottom of the router jig 100.

One of ordinary skill in the art will recognize that the invention may be used on multiple thin pieces of wood for "stepping" to make multiple cuts.

The present invention may be made of durable material, which may include metal, plastic, or wood. Metal can come from machined aluminum, aluminum weldment or castings, or similar steel or alloy. Molded or machine plastic can be used with recommended strengthening and stiffening features like ribs or other sectioning techniques. In one or more embodiments, the parts may compose black anodized aluminum for the body, aluminum centering tool, aluminum clamps, and plastic clamp adjusters. The particular thickness and other dimensions of the materials are not particularly important, so long as the pieces are necessarily durable for the purpose of securing a router during mortise cuts.

The present invention may include any number of nuts, bolts, and screws for securing the various router stops and the clamps, locks, or mounting brackets in place. The length and width of the jig itself and the corresponding router stops adjusters, brackets, and locks, and clamps may be of varying dimension. The user, however, will note that the dimensions must be of appropriate length to accommodate commercially available routers for creating mortises. These figures should not be considered limiting. For example, the slots could be made narrower, thinner, deeper, and/or wider for different size joints.

Although particular embodiments of the invention herein have been described, it is not limited to this description. It is therefore to be understood that numerous modifications may be made to the embodiments without departing from the spirit and scope of the present invention.

For instance, the present invention as discussed above includes two router bit slots. The invention, however, may include one or any number of router bit slots. Also, the clamps could be replaced with either a single clamp or a greater number of clamps, depending possibly on the number of router bit slots.

Similarly, the materials used can vary between embodiments. The invention has been generally described as various combinations of metal, plastic, or wood. One of ordinary skill in the art will recognize the possibility for additional variations such as the use of production via casting rather than traditional plates. The hardware used in the jig can comprise brass parts just as easily as nylon or other plastic parts. Those components of the invention that are metal may be anodized or non-anodized.

Additional features can be embodied with the centering tool for storage with the jig. For instance, the centering tool could be threaded and stored with a corresponding threaded piece of the jig. Alternatively, a storage compartment—slightly larger than the centering tool—with a door or slide out could be added to the jig so as to store the centering tool when not in use.

While the disclosure has been described with reference to exemplary embodiments, it will be understood by those skilled in the art that various changes may be made and equivalents may be substituted for elements thereof without departing from the scope of the disclosure. Therefore, it is intended that the disclosure not be limited to the particular embodiments disclosed for carrying out this disclosure, but that the disclosure will include all embodiments falling within the scope of the appended claims. Moreover, the use of the terms first, second, etc. do not denote any order or importance, but rather the terms first, second, etc. are used to distinguish one element from another.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The description of the present disclosure has been presented for purposes of illustration and description, but is not intended to be exhaustive or limited to the disclosure in the form disclosed. Many modifications and variations will be apparent to those of ordinary skill in the art without departing from the scope of the disclosure. The described embodiments were chosen and described in order to best explain the principles of the disclosure and the practical application, and to enable others of ordinary skill in the art to understand the disclosure for various embodiments with various modifications as are suited to the particular use contemplated.

What is claimed is:

1. A router jig comprising:

a router jig base comprising:

a first board guide that receives an end of a first board from a first lateral side of the router jig base;

a second board guide that receives an end of an aligned second board from a second lateral side of the router jig base that is opposite to the first lateral side; and a router guide that receives and guides a finger joint tool of a hand router along a transverse direction to the first and second board guides to simultaneously impart finger joint grooves to the first and second boards;

a first clamp that secures the first board in the first board guide; and a second clamp that secures the second board in the second board guide, wherein at least one of the first and second clamps comprises:

a clamping block slidably engaged to the router jig base to move into lateral contact with a corresponding one of the first and second boards; and a clamping arm attached to the clamping block and vertically lockable to secure the corresponding one of the first and second boards.

2. A router jig of claim 1, comprising:

a router jig base comprising:

a first board guide comprising a first baseplate that receives an end of a first board from a first lateral side of the router jig base;

a second board guide comprising a second baseplate that receives an end of an aligned second board from a second lateral side of the router jig base that is opposite to the first lateral side, wherein the first baseplate of the first board guide has a finger groove height difference with the second baseplate of the second board guide and the second board has an identical cross section as the first board; and a router guide that receives and guides a finger joint tool of a hand router along a transverse direction to the first and second board guides to simultaneously impart finger joint grooves;

a first clamp that secures the first board in the first board guide; and a second clamp that secures the second board in the first board guide.

3. The router jig of claim 2, wherein the router guide comprises a fixed top guide in parallel with an adjustable top guide.

4. The router jig of claim 2, wherein at least one of the first and second clamps comprises:

a clamping block slidably engaged to the router jig base to move into lateral contact with a corresponding one of the first and second boards; and a clamping arm attached to the clamping block and vertically lockable to secure the corresponding one of the first and second boards.

5. The router jig of claim 2, wherein the router jig base comprises a bottom protruding front member to abut an edge of a worktable.

6. A method of creating joints between a plurality of boards, comprising the steps of:

utilizing a router jig base having a first board guide that receives an end of a first board from a first lateral side of the router jig base; a second board guide that receives an end of an aligned second board from a second lateral side of the router jig base that is opposite to the first lateral side; and a router guide that receives and guides a finger joint tool of a hand router along a transverse direction to the first and second board guides to simultaneously impart finger joint grooves; a first clamp that secures the first board in the first board guide; and a second clamp that secures the second board in the second board guide;

securing a first board positioned adjacent to the first board guide by engaging the first adjustable clamp with the first board;

securing a second board positioned adjacent to the second board guide by engaging the second adjustable clamp;

moving a hand router along the length of the router guide that receives and guides a finger joint tool of the hand router along a transverse direction to the first and second board guides to simultaneously impart finger joint grooves.

7. The router jig of claim 2, wherein:

the first baseplate is fixedly attached to the first board guide; and the second baseplate is fixedly attached to the second board guide at the finger groove height difference from the first baseplate.

8. The router jig of claim 2, wherein the first baseplate comprises a shim board of thickness that corresponds to specific dimension of the finger joints.

9. The router jig of claim 2, further comprising an adjustment mechanism that raises one of the first and second baseplates relative to the other.

10. The router jib of claim 1, wherein the first baseplate of the first board guide has a finger groove height difference with the second baseplate of the second board guide and the second board has an identical cross section as the first board.

11. The router jig of claim 1, wherein the router guide comprises a fixed top guide in parallel with an adjustable top guide.

12. The router jig of claim 1, wherein at least one of the first and second clamps comprises:

a clamping block slidably engaged to the router jig base to move into lateral contact with a corresponding one of the first and second boards; and a clamping arm attached to the clamping block and vertically lockable to secure the corresponding one of the first and second boards.

13. The router jig of claim 1, wherein the router jig base comprises a bottom protruding front member to abut an edge of a worktable.

* * * * *